US008060982B2

(12) United States Patent
Magoz et al.

(10) Patent No.: US 8,060,982 B2
(45) Date of Patent: Nov. 22, 2011

(54) DOOR SAFETY MECHANISM

(76) Inventors: Assi Magoz, Hadera (IL); Ziv Magoz, Bellevue, WA (US)

( * ) Notice: Subject to any disclaimer, the term of this patent is extended or adjusted under 35 U.S.C. 154(b) by 0 days.

(21) Appl. No.: 12/677,525

(22) PCT Filed: Sep. 16, 2008

(86) PCT No.: PCT/IL2008/001225

§ 371 (c)(1),
(2), (4) Date: Mar. 11, 2010

(87) PCT Pub. No.: WO2009/037695

PCT Pub. Date: Mar. 26, 2009

(65) Prior Publication Data

US 2010/0192326 A1 Aug. 5, 2010

(30) Foreign Application Priority Data

Sep. 20, 2007 (GB) ..... 0718354.4
Dec. 18, 2007 (GB) ..... 0724585.5

(51) Int. Cl.
*E05F 5/04* (2006.01)

(52) U.S. Cl. ..... 16/83; 16/82; 49/70; 49/462

(58) Field of Classification Search ..... 292/DIG. 15; 16/82–86 C

See application file for complete search history.

(56) References Cited

U.S. PATENT DOCUMENTS

| | | | | | |
|---|---|---|---|---|---|
| 1,685,023 | A * | 9/1928 | Cowan | 16/83 |
| 2,175,403 | A * | 10/1939 | Larson | 16/83 |
| 2,526,616 | A | 10/1950 | Briggs | |
| 3,800,360 | A * | 4/1974 | Knarreborg | 16/83 |
| 3,989,286 | A | 11/1976 | Cleff | |
| 4,016,439 | A * | 4/1977 | Sheridan | 310/39 |
| 4,165,553 | A | 8/1979 | Salerno | |
| 4,261,140 | A * | 4/1981 | McLean | 49/383 |
| 4,982,474 | A * | 1/1991 | Kjellstrom | 16/82 |
| 5,369,840 | A * | 12/1994 | Salvador et al. | 16/82 |
| 5,485,733 | A | 1/1996 | Hoffman | |
| 6,550,186 | B2 | 4/2003 | Haq | |
| 6,588,811 | B1 | 7/2003 | Ferguson | |
| 6,874,198 | B2 | 4/2005 | Renaud | |
| 2010/0050377 | A1 * | 3/2010 | Ritachka | 16/83 |

* cited by examiner

*Primary Examiner* — Victor Batson
*Assistant Examiner* — Matthew Sullivan

(57) ABSTRACT

A safety mechanism for preventing door slamming includes a board and a pivot extending from the board. A rotatable arm is attached at a first end to the pivot. Door arresting wedge (AW) is attached substantially perpendicularly to the second end of the arm. One or more magnets are disposed on the board for attracting the arm. One or more magnets disposed on an edge of the arm, and a matching stopper is used to limit the rotation of the arm.

15 Claims, 5 Drawing Sheets

DOOR SAFETY MECHANISM

This application claims priority to and the benefit of GB patent application number 0718354.4 filed on 20 Sep. 2007 and GB patent application number 0724585.5 filed on 18 Dec. 2007, the entire contents of which are incorporated herein by reference.

FIELD OF THE INVENTION

The present invention relates to door safety mechanisms. More specifically, the present invention relates to safety aspects of door closing in buildings and vehicles.

BACKGROUND OF THE INVENTION

Injuries may occur when hands or fingers are caught in a closing door. Such closing doors can cause relatively minor pain and bruises, but may also inflict a greater damage especially when greater force is involved. Typically children and teenagers may be involved in more serious injuries. Schoolchildren playing at recesses between classes are accident prone.

US patent application US2002/000293779, the contents of which are incorporated herewith by reference, discloses a gravity actuated door safety device, which prevents injury to fingers and pet's tails. a swinging door safety device including a pair of spaced parallel bars connected to one another at one end by a crossbar. At the opposite end of each bar, a counterweight is provided. Each bar has a ring attached at a point between the first and second ends. With the rings mounted to oppositely facing door knobs such that the crossbar spans the leading edge of the door, gravity acting on the counterweight biases the device to rotate such that the bars extend outward from the leading edge and prevent closure of the door by contacting the door jamb.

US patent application US2002/157319, the contents of which are incorporated herewith by reference, discloses a mechanism for preventing injury to a person's hand when a fast-closing door slams a door frame or jamb. The mechanism includes a casing which is positioned within a hollowed out portion of the door. The casing is constructed with an opening disposed along the edge of the door panel. A metallic pendulum is housed and suspended within the casing such that the action of centrifugal force imparted by a fast-closing door will cause the pendulum to swing outwardly through the opening. A raised metal body is attached to the side molding of the door jamb and functions to engage the outwardly swung pendulum to prevent the door from completely closing.

BRIEF DESCRIPTION OF THE DRAWINGS

FIGS. 1A and 1B are isometric views of a door safety mechanism in accordance with an embodiment of the present invention, wherein FIG. 1B shows an arm prevented from rotation by a stopper

DETAILED DESCRIPTION OF EMBODIMENTS OF PRESENT INVENTION

Figure 1B:
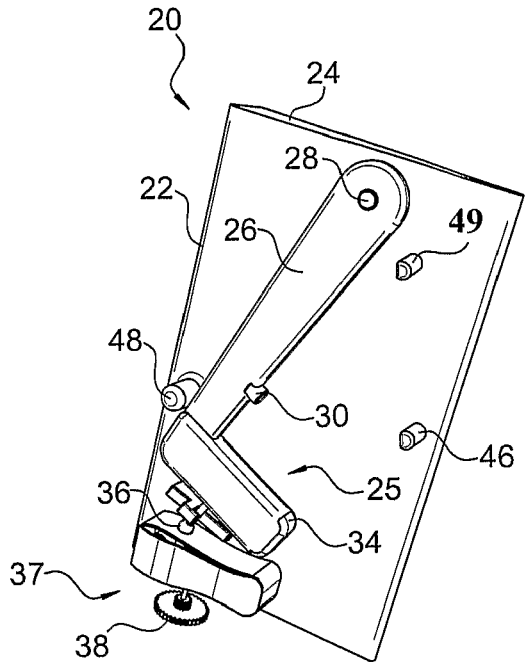
Figure 1A:
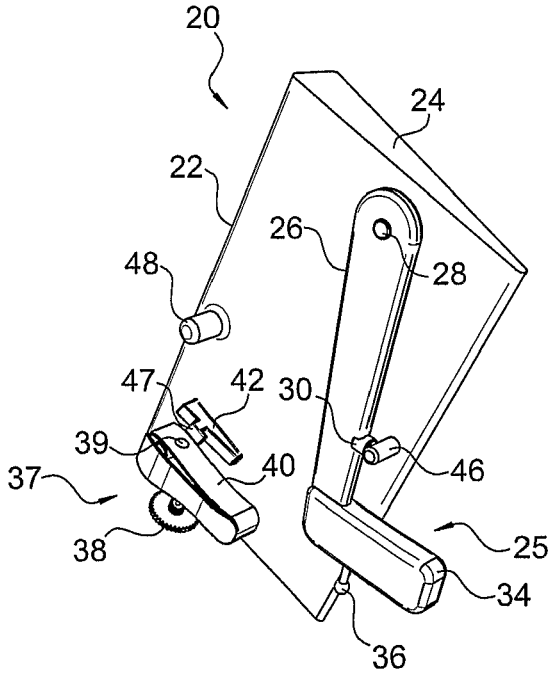

An isometric view of a door safety mechanism (DSM) 20 in accordance with a preferred embodiment of the present invention is shown in FIGS. 1A-1B to which reference is now made. Door safety mechanism (DSM) 20 includes base board 22 which is made of a rigid material such as wood, metal, plastic or any combination thereof. Board 22 is slanted sideways as can be seen by the triangular shape of the section of wall 24 so that door arresting to wedge 25 (AW) is disposed at an angle in respect to the door. The top end of arm 26 is pivotally attached to board 22 by pivot 28 such that the arm is freely rotatable. The pivot may be perpendicular or slanted with respect to the surface of the board. The arm further includes one or more magnet elements 30 disposed on the edge of arm 26. The arm is typically made of an elastic material such as rubber, plastic or any combination thereof.

In some embodiments of the present invention pivot 28 can be detached temporarily such as by unscrewing, in order to arrange positioning arm 26 in the opposite direction. Door arresting wedge (AW) 25 is attached substantially perpendicularly to the bottom end of arm 26. Pin 36 is attached on bottom side of AW 25. The AW is typically made of plastic, wood, rubber or any combination thereof. The DSM further includes stopper 37 which is used to prevent the arm from rotating. In this case, stopper 37 is characterized by having a surface level which is changeable by rotation of adjustment element 38. Recess 39 is disposed on surface 40. Protruding element 42 is a static element extending from the upper surface of the board and is disposed above stopper 38. Protruding element (PE) 42 has a structured surface and is used to guide pin 36 along the edge of the PE while the door is closed. Forward limiter 46 (FL) limits arm 26 in its forward movement when the door, not shown, is urged sufficiently to cause arm 26 to reach to FL 46. Hooked projection 47 on PE 42 limits the retraction of the arm beyond a certain angle, on its way away from the frame of the door. In some embodiments of the invention static protrusion member 48 is used to prevent the arm from rotating beyond a certain degree while the arm rotates towards the stopper.

Referring now to FIG. 1B, in one aspect of the present invention at least part of the arm 26 is made of metal and magnet 49 is used for attracting arm 26.

Figure 2A:
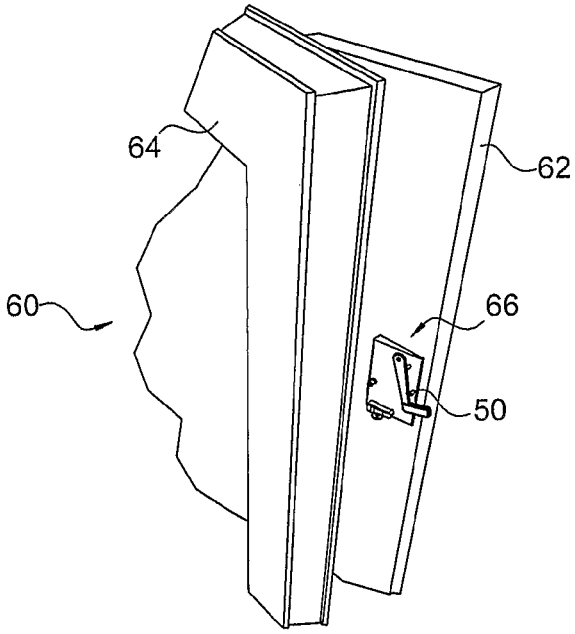
FIG. 2A is an isometric section view of a door structure associated with a door safety mechanism in accordance with one embodiment of the present invention wherein the arm is released from the stopper.
Figure 2B:
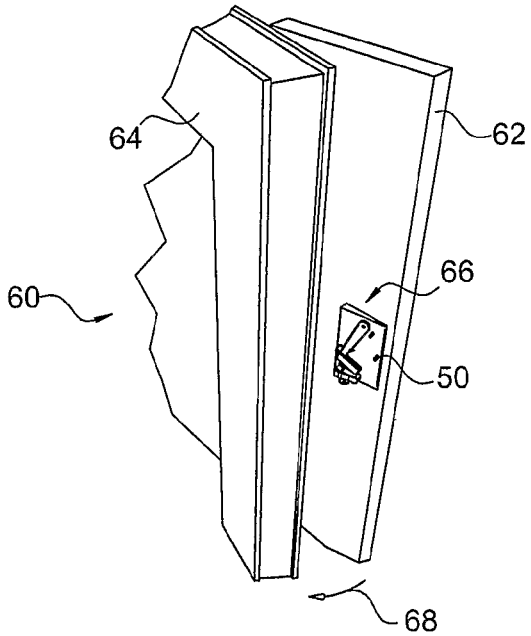
FIG. 2B is an isometric section view of a door structure associated with a door safety mechanism in accordance with one embodiment of the present invention wherein rotation of the arm is prevented by a stopper.

An isometric section view of a door structure associated with the door safety mechanism in accordance with a preferred embodiment of the present is invention is shown in FIG. 2A to which reference is now made. Door structure 60 includes door 62 and door frame 64. DSM 66 is attached to door 62 and is disposed in the region near door edge facing the door frame. Referring now to FIG. 2B when door 62 is slammed towards door frame 64, the slamming force overcomes the grip force of the stopper and the arm is released from the stopper and rotates towards magnet 50. The door movement direction is designated by arrow 68.

In one aspect of the present invention the degree of rotation of the arm away from the stopper is controlled by selecting an angle for the DSM. The angle is determined for example by rotating the board around a pivot. The degree of the board rotation is used for controlling the arm movement in associate with the degree of door closing.

Figure 3A:
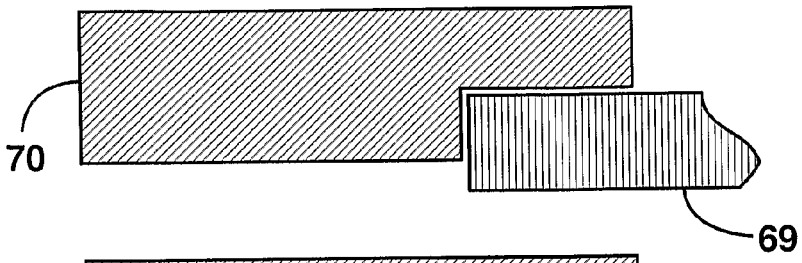
FIG. 3A is a cross sectional view of a door structure.
Figure 3B:
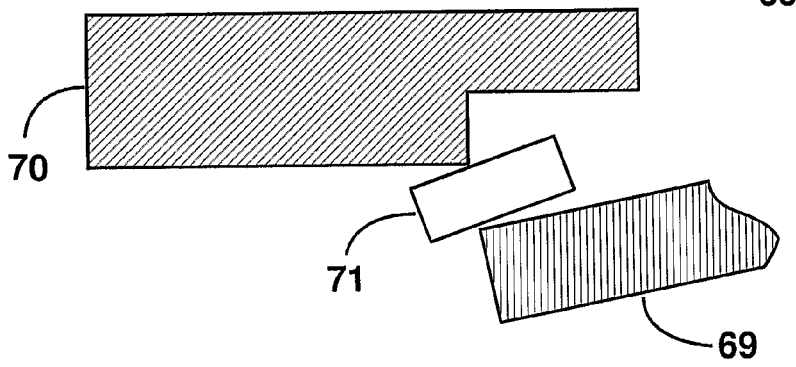
FIG. 3B is a cross sectional view of a door structure associated with a door arresting wedge (AW)
Figure 3C:
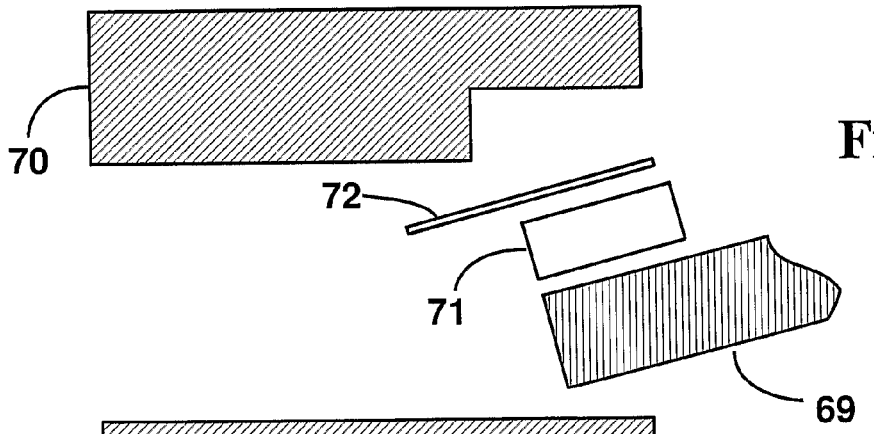
FIG. 3C is a cross sectional view of a door structure associated with an AW and a buffer.
Figure 3D:
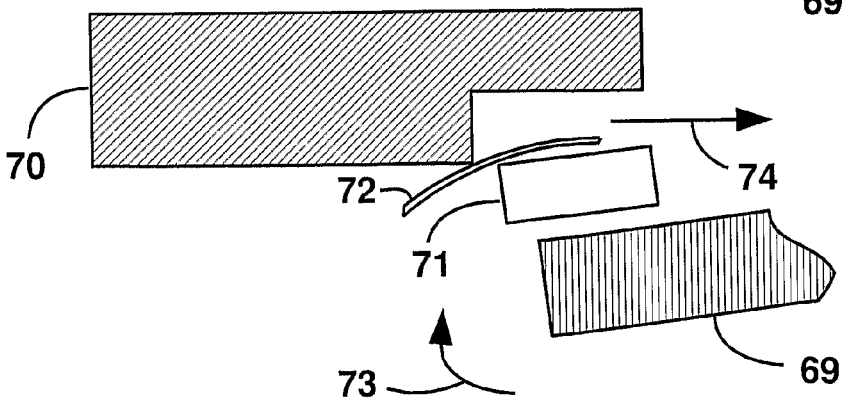
FIG. 3D is a cross sectional view of a door structure associated with the buffer which is used for preventing the protrusion of the AW and pushing it to a retracted position.

A sectional view of a door structure without a DSM is shown in FIG. 3A to which reference is now made. Door 69 is in closed position, when portion of the door substantially presses against a portion of door frame 70. A similar view showing the effect of an AW on the door closure is shown in FIG. 3B to which reference is now made. In this case door 69 is urged towards door frame 70 at a speed that would produce a slamming effect causing AW 71 to swing outwardly from the door, preventing the engagement of door 69 with door frame 70. In another situation, better explained by referring again to FIG. 1A, the door is urged in a torque insufficient to cause arm 26 to attach to FL 46, arm 26 may in this case either return to its standby position, or be immobilized by AW 25 being caught between the door and the door frame. In another aspect of the invention, the AW and the associated arm are retracted from the door frame by the quenching effect of a buffer, not shown, preventing the protrusion of the AW and pushing it to a retracted position. A sectional view of the door structure showing an AW and a buffer is described in FIG. 3C. Buffer 72, is typically a strap made of flexible material such as plastic or rubber. The buffer is positioned such that when the door is closed the buffer engages the door frame before AW 71. Now referring to FIG. 3D when the door is urged in the direction as indicated by arrow 73 and buffer 72 engages door frame 70, buffer 72 begins to bend. Subsequently, AW 71 strikes the buffer and by the quenching effect of the buffer the AW returns as indicated by arrow 74 towards the stopper, not shown.

In another embodiment of the present invention the DSM is disposed within a hollowed out portion of a door panel rather than on the outer surface of the door. Typically such embodiment is suitable for vehicle doors.

Figure 4A:
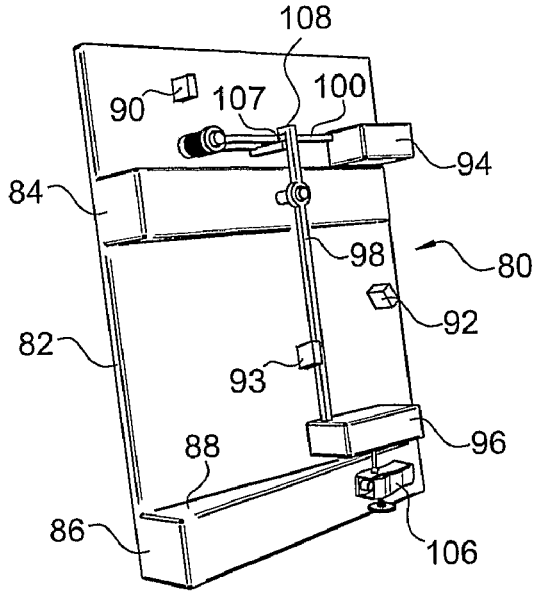
FIG. 4A is an isometric view of a door safety mechanism in accordance with some embodiments of the present invention, associated with two stoppers in standby position.
Figure 4B:
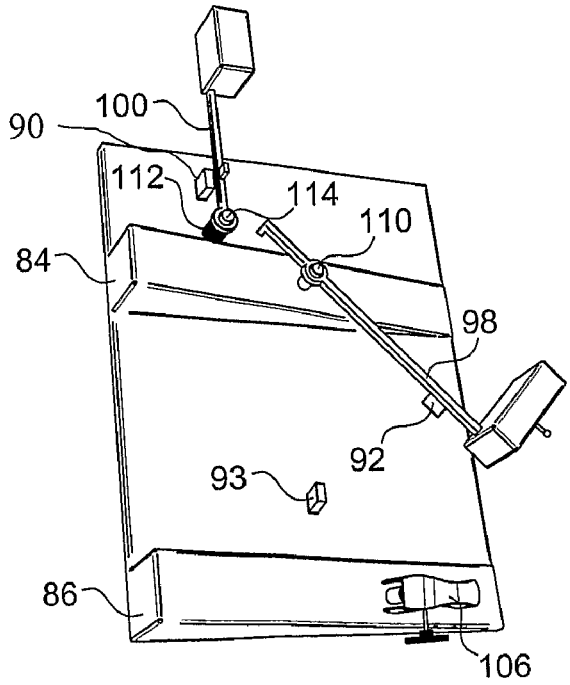
FIG. 4B is an isometric view of a door safety mechanism in accordance with some embodiments of the present invention associated with two stoppers in blocking position.

An isometric view of a door safety mechanism in accordance with another embodiment of the present invention associated with two AW is shown in FIGS. 4A-4B to which reference is now made. In FIG. 4A door safety mechanism 80 includes two AWs referred to hereinafter as the double arresting wedge (DAW) embodiment. Mechanism 80 includes board 82 and two protruding elements 84 and 86. The elements are slanted as can be seen by the triangular shape of wall 88. The DAW further includes one or more magnets 90, 92 and 93. Arresting wedges 94 and 96 are attached substantially perpendicularly to the bottom end of arms 98 and 100 respectively. The DAW referred to as in standby-position when arms 98 and 100 are anchored in stoppers 106 and 108 respectively. Arm 98 is attracted to magnet 93 and a hooked extension at the top side of arm 98 parks on top of protruding element 107 extending from arm 100.

Reference is now made to FIG. 4B, when the door is slammed, the DAW changes from the standby to the blocking position. Arm 98 is rotatable around pivot 110 is shown released from stopper 106 and reaching towards magnet 92 along with the pivot. Spring 112 is mounted about pivot 114. Due to the release of hold by rotated arm 98 and urge of spring 112, arm 100 mounted on pivot 114 rotates towards magnet 90. When the door safety mechanism is in blocking position, arm 98 is attached to magnet 92, arm 100 is attached to magnet 90 and arresting wedges 94 and 96 block the closure of the door in two places.

Figure 5:
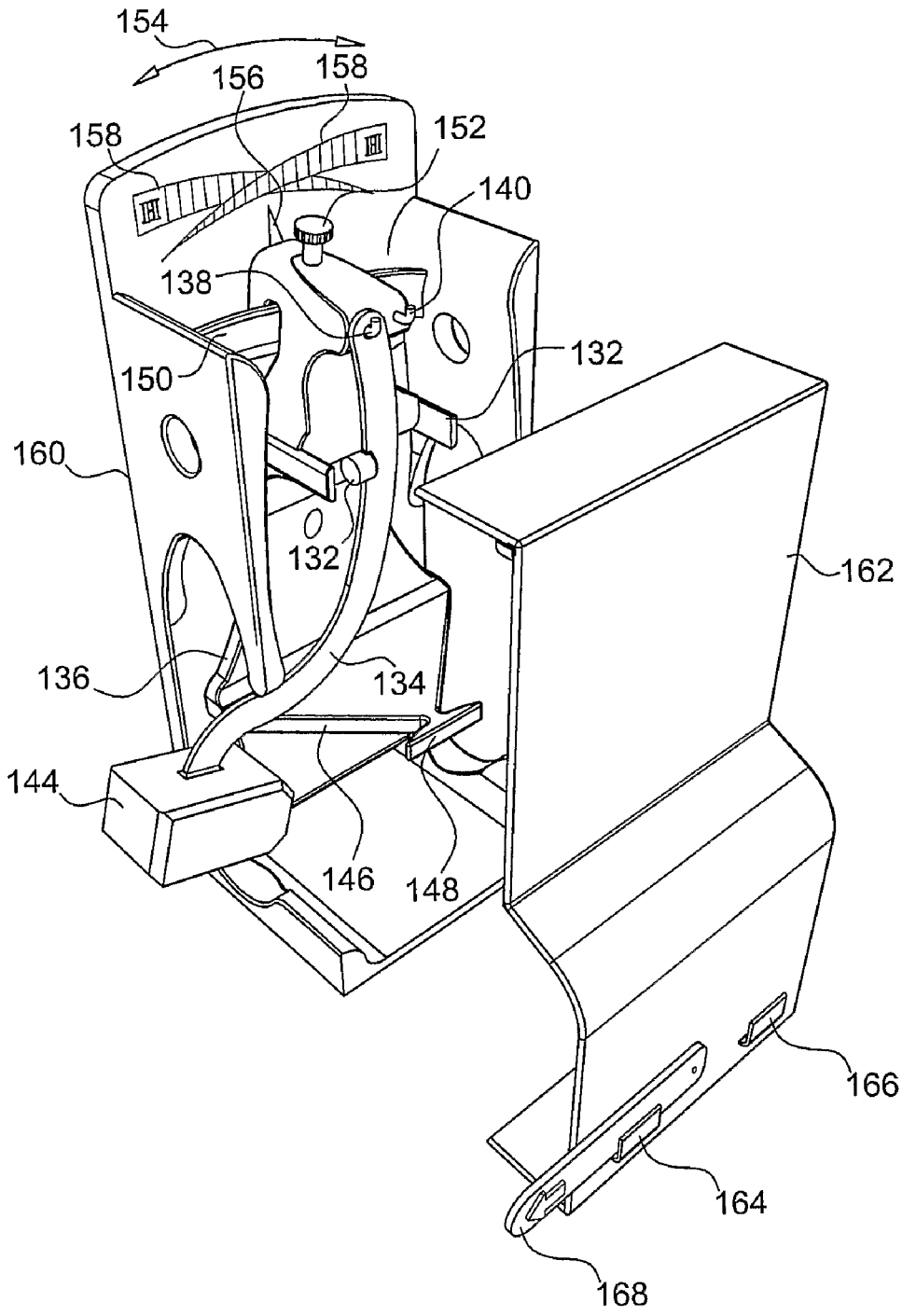
FIG. 5 is an isometric partially exploded view of a door safety mechanism in accordance with some embodiments of the present invention wherein an arm is guided along the edge of a protruding element.

An isometric view of a door safety mechanism in accordance with a preferred embodiment of the present invention in which an arm is guided along the edge of a protruding element is shown in FIG. 5 to which reference is now made. Safety mechanism 130 includes one or more metal attracting elements 132 such as magnets and electromagnets. The top end of arm 134 is pivotally attached to door safety subassembly (DSSA) 136 by pivot 138 such that the arm is freely rotatable. In one aspect of the present invention arm 134 can be positioned in the opposite direction with respect to the arm position as shown in the figure, by hanging on pivot 140. Door arresting wedge (AW) 144 is attached substantially perpendicularly to the bottom end of arm 134. Protruding element 146 is a static element extending from the surface of (DSSA) 136. Protruding element (PE) 146 has a structured surface and is used to guide arm 134 along is the edge of the PE while the door is closed. Hooked projection 148 on PE 146 limits the retraction of the arm beyond a certain angle, on its way away from the frame of the door. The degree of rotation of the arm away from hooked projection 148 is controlled by selecting an angle for DSSA 136. The angle is determined by sliding DSSA 136, along track 150 and locking its position by a locking screw 152. The DSSA moves in a direction as indicated by double headed arrow 154. DSSA 136 further includes pointer 156 which is mounted on top of DSSA 136. The pointer is used for pointing on scales 158 to indicate the rotation level of the DSSA. Lateral surfaces of board assembly housing 160 have apertures that enable door safety mechanism to assume blocking position when the door is slammed. Cover 162 includes hooks 164, 166 respectively. Buffer 168 is pivotally connected to cover 162 and rests upon hook 164. When arm 134 is positioned in the opposite direction on pivot 140, arm buffer 168 can be pivotally rotated to the opposite side to rest upon hook 166. In one embodiment of the present invention an external cover not shown is attached to outer surface of cover 162 for example by mounting the bottom edge of the external cover on hooks 164,166, for aesthetic reasons.

The invention claimed is:

1. A safety mechanism for preventing slamming of a door, the mechanism comprising:

a board attached to said door;

a pivot extending from said board;

an arm comprising a first end and a second end rotatably attached at said first end to said pivot;

a sloped element, substantially protruding from said board, wherein a closing movement of the door causes said arm to be impinged on the sloped element as the door closes, to produce movement along a sloped surface of said sloped element and guide said arm along an edge of said sloped element;

a door arresting wedge (AW) attached substantially perpendicularly to said second end of said arm;

at least one magnet disposed on said board for attracting said arm;

at least one magnet disposed on an edge of said arm, and at least one stopper to limit the rotation of said arm.

2. A safety mechanism for the prevention of door slamming as in claim 1, wherein said mechanism is disposed on the outer surface of said door.

3. A safety mechanism for the prevention of door slamming as in claim 1, wherein an external cover is attached to said safety mechanism.

4. A safety mechanism for the prevention of door slamming as in claim 1, wherein said mechanism is disposed within a hollowed out portion of said door panel.

5. A safety mechanism for the prevention of door slamming as in claim 4, wherein said door is a door of a vehicle.

6. A safety mechanism for the prevention of door slamming as in claim 1, wherein a pin is attached to the bottom side of said AW.

7. A safety mechanism for the prevention of door slamming as in claim 1, further comprising a static element extending from the surface of said board, for guiding said pin along the edge of said protruding element while said door is closed.

8. A safety mechanism for the prevention of door slamming as in claim 7, wherein said static element extends from a door safety sub-assembly for guiding said arm along the edge of said protruding element while said door is closed.

9. A safety mechanism for the prevention of door slamming as in claim 8, wherein the initial degree of rotation of said arm away from said stopper is controlled by determining an angle for said door safety sub-assembly.

10. A safety mechanism for the prevention of door slamming as in claim 1, wherein said mechanism further comprising a buffer for preventing the protrusion of said AW in case it has not attached to a metal attracting element.

11. A safety mechanism for the prevention of door slamming as in claim 1, wherein said arm is detachable from said pivot for positioning said arm in an opposite direction.

12. A safety mechanism for the prevention of door slamming as in claim 1, wherein said board is slanted.

13. A safety mechanism for the prevention of door slamming as in claim 1, further comprising a second AW attached substantially perpendicularly to one end of a second arm whereas the opposite end of said second arm is pivotally attached to said board by a second pivot, and wherein a spring is mounted on said second pivot such that said second arm is rotatable due to the urge of said spring.

14. A safety mechanism for the prevention of door slamming as in claim 1, wherein said metal attracting element is a magnet.

15. A safety mechanism for the prevention of door slamming as in claim 1, wherein said metal attracting element is an electro-magnet.

* * * * *